US009170080B2

(12) United States Patent
Poore et al.

(10) Patent No.: US 9,170,080 B2
(45) Date of Patent: Oct. 27, 2015

(54) RELOADING KIT WITH LEAD FREE BULLET COMPOSITION

(71) Applicant: Alliant Techsystems Inc., Minneapolis, MN (US)

(72) Inventors: Rochelle D. Poore, Andover, MN (US); Daniel B. Shipman, Oroville, CA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 14/208,271

(22) Filed: Mar. 13, 2014

(65) Prior Publication Data

US 2014/0260926 A1 Sep. 18, 2014

Related U.S. Application Data

(60) Provisional application No. 61/802,362, filed on Mar. 15, 2013.

(51) Int. Cl.

| | |
|---|---|
| ***F42B 33/00*** | (2006.01) |
| ***F42B 12/74*** | (2006.01) |
| ***F42B 30/02*** | (2006.01) |
| ***F42B 33/02*** | (2006.01) |
| ***F42B 33/04*** | (2006.01) |
| ***F42B 33/10*** | (2006.01) |

(52) U.S. Cl.

CPC ..... *F42B 12/745* (2013.01); *F42B 30/02* (2013.01); *F42B 33/001* (2013.01); *F42B 33/002* (2013.01); *F42B 33/0207* (2013.01); *F42B 33/04* (2013.01); *F42B 33/10* (2013.01)

(58) Field of Classification Search

CPC ..... F42B 12/745; F42B 30/02; F42B 33/001; F42B 33/0207; F42B 33/04; F42B 33/002

USPC ..... 86/10, 18, 23, 25, 54, 57

See application file for complete search history.

(56) References Cited

U.S. PATENT DOCUMENTS

| | | | | |
|---|---|---|---|---|
| 4,503,777 | A | 3/1985 | Young | |
| 5,012,743 | A | 5/1991 | Denis et al. | |
| 5,183,963 | A | 2/1993 | Beaufils et al. | |
| RE34,612 | E | 5/1994 | Bender et al. | |
| 5,341,717 | A * | 8/1994 | Feldman | 86/32 |
| 5,394,597 | A | 3/1995 | White | |

(Continued)

FOREIGN PATENT DOCUMENTS

| | | |
|---|---|---|
| DE | 92 09 598 | 12/1992 |
| WO | WO 92/08097 | 5/1992 |

(Continued)

OTHER PUBLICATIONS

Cast Boolits, GunLoads.com. People swaging plastic airsoft bullets. 2005. Accessed online Mar. 4, 2013, at: http://castboolits.gunloads.com/showthread.php?68013-Swaging-Plastic (6 pages).

(Continued)

*Primary Examiner* — Bret Hayes

(74) *Attorney, Agent, or Firm* — Christensen Fonder, P.A.

(57) ABSTRACT

The present disclosure is directed to reloading kits containing a packaged high-density metal-filled polymer composition that is moldable and used in producing lead-free or "green" bullets for individual firearms. Such kits and compositions may be used by individuals in their reloading process.

15 Claims, 8 Drawing Sheets

(56) References Cited

U.S. PATENT DOCUMENTS

| | | | | |
|---|---|---|---|---|
| 5,399,187 | A | 3/1995 | Mravic et al. | |
| 5,535,495 | A * | 7/1996 | Gutowski | 86/54 |
| 5,540,749 | A | 7/1996 | Li et al. | |
| 5,665,808 | A | 9/1997 | Bilsbury et al. | |
| 5,760,331 | A | 6/1998 | Lowden et al. | |
| 6,048,379 | A | 4/2000 | Bray et al. | |
| 6,178,890 | B1 | 1/2001 | Burczynski | |
| 6,257,149 | B1 | 7/2001 | Cesaroni | |
| 6,561,070 | B2 | 5/2003 | Weber | |
| 6,613,165 | B1 | 9/2003 | Alexander | |
| 7,222,573 | B2 | 5/2007 | Pontieri | |
| 7,503,260 | B2 | 3/2009 | Kapeles | |
| 7,640,861 | B2 | 1/2010 | Amick | |
| 2003/0101891 | A1 | 6/2003 | Amick | |
| 2004/0129165 | A1 * | 7/2004 | Cesaroni | 102/516 |
| 2004/0216589 | A1 * | 11/2004 | Amick | 86/54 |
| 2005/0081704 | A1 * | 4/2005 | Husseini | 86/55 |
| 2006/0027129 | A1 | 2/2006 | Kolb et al. | |
| 2006/0042456 | A1 * | 3/2006 | Petersen | 86/54 |
| 2006/0283314 | A1 | 12/2006 | Cesaroni | |
| 2007/0000404 | A1 | 1/2007 | Eberhart | |
| 2007/0151473 | A1 | 7/2007 | Brunn | |
| 2010/0180757 | A1 * | 7/2010 | Park et al. | 86/23 |
| 2012/0204707 | A1 * | 8/2012 | Park et al. | 86/54 |
| 2013/0025490 | A1 * | 1/2013 | Burczynski | 102/439 |

FOREIGN PATENT DOCUMENTS

| | | |
|---|---|---|
| WO | WO 95/08748 | 3/1995 |
| WO | WO 95/23952 | 9/1995 |
| WO | WO 2013/016330 A1 | 1/2013 |

OTHER PUBLICATIONS

Corbin, D.R. Plastic Tip Rifle Bullets. *Corbin Handbook of Bullet Swaging*, No. 7. 1986. Accessed online Mar. 4, 2013, at: http://www.ssrsi.org/Onsite/BBStext/bullet1.htm (2 pages).

Corbin. Corbin Bullet Balls. Accessed online Mar. 2, 2013, at: http://www.corbins.com/bball.htm (4 pages).

Corbin. Introduction to Bullet Swaging. Accessed online Mar. 1, 2013, at: http://www.corbins.com/intro.htm (7 pages).

Long, Duncan. Best Bullets and Other Projectiles. *Homemade Ammo: How to make It, How to Reload It, How to Cache It*. Mar. 1995. pp. 69-70; Ch. 4. (3 pages).

National Institute of Justice. "Lead-Free Bullets." Firearm Examiner Training, Module 05. Accessed online Mar. 4, 2013, at: http://www.nij.gov/training/firearms-training/module05/fir_m05_t05_09a.htm (1 page).

Sportsman's Warehouse. Lyman Deluxe Crusher Press Reloading Kit Product Information. Reloading Presses and Kits. Accessed online Mar. 4, 2013. Available at: http://www.sportsmanswarehouse.com/sportsmans/Lyman-Deluxe-Crusher-Press-Reloading-Kit/productDetail/Reloading-Presses-and-Kits/prod9999002472/cat100158 (2 pages).

Sportsman's Warehouse. Reloading Kits. Accessed online Mar. 4, 2013, at: http://www.sportsmanswarehouse.com/sportsmans/Reloading-Kits/category/cat100150 now available at: http://www.sportsmanswarehouse.com/sportsmans/Reloading-Presses-and-Kits/category/cat100158/sort/bestSellerasce/ipp/96/pn/1/trail/false/view/false (3 pages).

* cited by examiner

RELOADING KIT WITH LEAD FREE BULLET COMPOSITION

RELATED APPLICATIONS

This application claims the benefit of U.S. Provisional Patent Application No. 61/802,362, filed on Mar. 15, 2013, the disclosure of which is incorporated by reference herein in its entirety.

FIELD OF THE DISCLOSURE

The present disclosure is generally directed to a reloading kit containing a packaged moldable composition of matter used in producing "green" lead-free bullets for individual firearms. More particularly, the present disclosure is directed to a reloading kit including reloading equipment and a packaged moldable composition comprising a high-density, metal-filled polymer material for reloading processes for standard private firearms.

BACKGROUND OF THE DISCLOSURE

Reloading (also referred to as handloading) is the process of loading firearm cartridges or shotgun shells by assembling the individual components (case/hull, primer, powder, and bullet/shot), rather than purchasing completely assembled, factory-loaded ammunition. This is done by individuals on a small scale and does not apply to manufacturers. Reloading involves the private making of cartridges and shells using new or previously fired cartridge cases and shotgun hulls using personally cast/molded or new bullets, shot, primers, and powder.

The ability to customize ammunition, economy, increased accuracy, performance, commercial ammunition shortages, and hobby interests are all common motivations for reloading both cartridges and shotshells. The reloading process can realize increased accuracy and precision through improved consistency of manufacture, by selecting the optimal bullet weight and design, and tailoring bullet velocity to the purpose. The equipment and materials used to assemble the cartridge also has an effect on its performance, uniformity/consistency and optimal shape/size. Modern reloading equipment enables a firearm owner to tailor fresh ammunition to a specific firearm.

The basic pieces of equipment for reloading includes a press, dies, a shellholder, a scale, priming tools, a powder measure, a bullet puller, a case trimmer and primer pocket tools. A press is a device that uses compound leverage to push the cases into the dies that perform the loading operations. Dies are used for sizing and decapping operation, to expand the case mouth of straight cases, neck expansion, and seating and crimping the bullet. Modern reloading dies are generally standardized with ⅞-14 (or, for the case of 50 BMG dies, with 1¼×12) threads and are interchangeable with all common brands of presses, although older dies may use other threads and be press-specific. A shellholder is used to hold a case in place as it is forced into and out of the dies. A precision scale is used for measuring powder for loading cartridges. Priming tools are used for priming the case. Powder measures can be used to accurately measure out powder. Bullet pullers are shaped like hammers and allow the reloader to disassemble mistakes by use of inertia to pull the bullet. Bullets are also used to disassemble loaded ammunition of questionable provenance or undesirable configuration, so that the components can be salvaged for re-use. Case trimmers are used on cases need to be trimmed to bring them back into proper specifications. Primer pocket cleaning tools are used to remove residual combustion debris remaining in the primer pocket. Further materials used in reloading include: cases or shot shell hulls; smokeless powder; and bullets, or shot and wads for shot shells; and primers. case lubricant may also be needed, depending on the dies used.

The reloading process depends on the achievement desired.

In the activity of reloading, the bullet is usually the most expensive part of the reloaded round, especially with handgun ammunition. Reloading can involve the processes of casting or swaging bullets. With these processes, the reloader can control many attributes of the resulting bullet. Bullet molds vary in shape and design allowing the reloader to pick the exact weight, shape, and diameter of the bullet to fit the cartridge, firearm, and intended use.

Casting is a method of obtaining bullets, buckshot, and slugs intended for reloading use at low to moderate velocities. Casting requires a set of bullet, buckshot, or slug molds. Reloaders can acquire lead for ammunition from many different sources, some new and some recycled. Soft lead bullets are generally used in handguns with velocities of 1000 ft/s (300 m/s) or lower, while harder cast bullets may be used, with careful powder selection, in rifles with velocities of 2000 ft/s (600 m/s) or slightly more.

In one embodiment, swaging involves jacketing bullets, especially for rifles and pistols. The hard jacket material, generally copper or brass, resists deformation and handles far higher pressures and temperatures than lead. Swaging includes forcing such jackets onto bullet cores via pressure. Swaged bullets, since they are formed at the temperature at which they will be used, can be formed in molds of the exact desired size.

Some reloaders use casting and swaging to get high precision results. It is common to cast the bullets slightly oversized, and then swage the resulting castings through a die to do the final forming. Since the amount of pressure required to size the bullet is far less than that required to form a bullet, a simple mechanical press can be used, often the same press used for handloading ammunition.

Reloading enthusiasts typically use lead containing materials for bullets. As part of the reloading process, it is common for lead alloy to be melted in high temperature pots and pouring into bullet molds. These bullets are then forced through a round die to size them to correct the round dimension. However, there are environmental and health concerns associated with lead projectiles. Lead projectiles left in the field (e.g., a marsh) can lead to increased lead levels in the ecosystem and the food chain. The use of lead projectiles in indoor firing ranges raises health concerns associated with lead dust and vapors that may be formed when lead bullets hit the down range back wall. Consequently, reloaders have turned to other sources of bullet material for use in their bullet molds and swaging equipment in their efforts to personally make their own bullets.

It would be desirable to provide reloaders with a safe alternative which approximates the size, density and weight of lead. It also would be desirable to provide a commercial product that comprises material suitable for shaping and making bullets and that removes handling and safety concerns that are typically associated with small particle size metal powders. It further would be desirable to provide a kit for the reloader enthusiast that contains all the necessary reloading equipment including safe, workable bullet material.

SUMMARY OF THE DISCLOSURE

Various embodiments of the disclosure are directed to reloading kits containing a packaged moldable composition of matter used in producing "green" lead-free bullets for individual firearms. Such kits and compositions may be used by individuals in their reloading process. In some embodiments, a high-density metal-filled polymer material that consumers can inject into a bullet shaped mold to form lead-free bullets. In one embodiment, the kit further provides for the ability of the consumer to swage commercially available jackets, for example copper jackets, around a cylindrical-shaped core of the composition material.

In one embodiment, the composition comprises: a polymer carrier/binder material; non-lead particles, such as tungsten, iron, copper, and alloys and mixtures thereof, dispersed in the polymer carrier/binder material. The concentration of the non-lead free particles may vary based on desired density and bullet weight. The composition is such that it may be molded or swaged into a bullet.

In one embodiment, there is provided, a kit for rifle and pistol ammunition reloaders for creating their own bullets, comprising: 1) a mold; 2) bullet core material; 3) a pressurizer configured to compress the core material; 4) a bullet jacket swaging device having a cavity geometry; and 5) metallic jackets, wherein the kit is made available to a consumer for purchase as a unit.

In one embodiment, there is provided a kit for rifle and pistol ammunition reloaders for creating their own bullets, wherein the core material comprises a packaged amount of a metallic-polymer composition suitable for forming into bullets and configuring into a cartridge using standard reloading equipment and processes.

In one embodiment, there is provided a kit for rifle and pistol ammunition reloaders for creating their own bullets, wherein the packaged amount of metallic-polymer composition comprises: material comprises: (a) a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; (b) a binder selected from the group consisting of thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein the composition substantially comprises, said first metal in an amount of from 50 percent by weight to 99.5 percent by weight, based on the total weight of said composition, and said binder in an suitable to bind the metals particles, and said composition is substantially free flowing.

In one embodiment, the kit further comprises an instruction guide, wherein the instruction guide includes instructions comprising the steps of:

a) providing the bullet core material from the kit;
b) cutting the composition to desired length or size;
c) placing the cut piece of composition material in a metal jacket;
d) compressing the jacket with the composition therein to form a bullet core using the pressurizer until a desired consistency of density is achieved;
e) removing leftover core material;
f) pressing the jacket with the core in the swaging device to conform the jacket and core to the cavity geometry to create a jacketed bullet; and
g) removing the jacketed bullet.

In one embodiment, the instruction guide further comprises the step of: loading the jacketed bullet using standard reloading equipment and processes.

In one embodiment, there is provided, a kit for rifle and pistol ammunition reloaders for creating their own bullets, comprising: 1) a heatable mold; 2) bullet core material; and 3) a heatable pressurizer configured to compress the core material, wherein the kit is made available to a consumer for purchase as a unit. A further embodiment of the kit is that the core material comprises a packaged amount of a metallic-polymer composition suitable for forming into bullets and configuring into a cartridge using standard reloading equipment and processes.

In one embodiment, the packaged amount of metallic-polymer composition further comprises: (a) a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; (b) a binder selected from the group consisting of thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein the composition substantially comprises, said first metal in an amount of from 50 percent by weight to 99.5 percent by weight, based on the total weight of said composition, and said binder in an amount suitable to bind the metals particles, and said composition is substantially free flowing.

In one embodiment, the kit further comprises an instruction guide, wherein the instruction guide includes instructions comprising the steps of:

a) providing the bullet core material from the kit;
b) dumping the bullet core material into a hopper;
c) heating the hopper and mixing the bullet core material sufficiently to mix and melt the bullet core material to a homogenous state, wherein the material exhibits flow qualities;
d) if the fluid characteristics of the resulting bullet core material are adequate for injecting, injecting the material by means of a forced mechanism into the heatable mold cavity, or if the viscosity of the resulting bullet core material is sufficiently low, pouring the bullet core material into a cavity of the heatable mold; and
e) closing and heating the heatable mold until the bullet core material is of a desired hardness, forming a bullet.

In one embodiment, the instruction guide further comprises the step of: Removing the formed bullet from the mold; and Loading the bullet using standard reloading equipment and processes.

In one embodiment, there is provided a kit for rifle and pistol ammunition reloaders for creating their own bullets, comprising: 1) a plurality of cartridge cases; 2) packaged bullet core material; and 3) gun powder, wherein the kit is made available to a consumer for purchase as a unit. The core material can comprise a packaged amount of a metallic-polymer composition suitable for forming into bullets and configuring into a cartridge using standard reloading equipment and processes.

In a further embodiment of the kit, the packaged amount of metallic-polymer composition comprises: material comprises: (a) a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; (b) a binder selected from the group consisting of thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein the composition substantially comprises, said first metal in an amount of from 50 percent by weight to 99.5 percent by weight, based on the total weight of said composition, and said binder in an amount suitable to bind the metals particles, and said composition is substantially free flowing.

In one embodiment, the kit further comprises a plurality of bullet jackets and a plurality of boxer primers and an instruction guide, wherein the instruction guide includes instructions comprising the steps of:

1) providing the bullet core material composition from an acquired kit or acquired separately;
2) making a jacketed bullet or a jacketless bullet using the bullet core material using reloading equipment and processes;
3) inserting the desired amount of gun powder into the cartridge case;
4) fitting a boxer primer into the rear end of the cartridge case; and
5) fitting the prepared jacketed or jacketless bullet into the open end of the cartridge case and securing.

The kits may further comprise one or more items chosen from the group consisting of: one or more reloading dies; bullet jackets; a scale; a priming tool; a powder measure; a bullet puller; a case trimmer; primer pocket tools; a press; cartridge cases; a sharp edge shaving tool for shaping the bullet core material prior to shaping or after; boxer primers; a shellholder; and smokeless powder.

In one embodiment, there is provided a packaged bullet core material for rifle and pistol ammunition for reloaders for creating their own bullets, wherein the packaged bullet core material is made available to a consumer for purchase, comprising: a packaged amount of a metallic-polymer composition suitable for forming into bullets and configuring into a cartridge using standard reloading equipment and processes. The packaged amount of metallic-polymer composition comprises: material may comprise: (a) a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; (b) a binder selected from the group consisting of thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein the composition substantially comprises, said first metal in an amount of from 50 percent by weight to 99.5 percent by weight, based on the total weight of said composition, and said binder in an amount suitable to bind the metals particles, and said composition is substantially free flowing. The packaged bullet core material may be in a form chosen from the group consisting of: a tube, a brick, measured aliquots and a rope-like spool, prior to packaging and packaged in such a form.

In one embodiment, there is provided a packaged bullet core material suitable for commercial sale to reloaders and suitable for forming into bullets and configuring into a cartridge using standard reloading equipment and processes comprising: (a) a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; (b) a binder selected from the group consisting of thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein the composition substantially comprises, said first metal in an amount of from 50 percent by weight to 99.5 percent by weight, based on the total weight of said composition, and said composition is substantially free flowing. In some embodiments, the bullet core material is in a form chosen from the group consisting of: a tube, a brick, measured aliquots and a rope-like spool, prior to packaging and packaged in such a form.

In one embodiment, there is provided a method of making a packaged bullet core material is disclosed suitable for commercial sale to reloaders and suitable for forming into bullets and configuring into a cartridge using standard reloading equipment and processes comprising the steps of:

(a) forming a particulate metal mixture comprising, a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof, and
(b) preparing a slurry comprising,
  (i) said homogenous particulate metal mixture,
  (ii) water,
  (iii) a binder selected from the group consisting of thermoplastics and/or thermosetting polymers, polyurethane, polyolefin, polyester, polyvinyl alcohol, poly (C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein said slurry contains, said first metal in an amount of from 50 to 99.5 percent by weight, based on the total weight of said slurry;

(c) passing said slurry through a spray drier, thereby forming a bullet core material, wherein said bullet core material substantially comprises, said first metal in an amount of from 50 percent by weight to 99.5 percent by weight, based on the total weight of said material, and said material is substantially free flowing; and (d) packaging the bullet core material in a form and method suitable for commercial sale to reloaders and suitable for forming into bullets and configuring into a cartridge using standard reloading equipment and processes.

In one embodiment, the bullet core material is in a form chosen from the group consisting of: a tube, a brick, measured aliquots and a rope-like spool, prior to packaging and packaged in such a form.

In one embodiment, the method of making a packaged bullet core material suitable for commercial sale to reloaders further comprises the steps of packaging the packaged bullet core material with reloading equipment chosen from the group consisting of: a pressurizer configured to compress the core material; a bullet jacket swaging device; metallic jackets; a heatable pressurizer configured to compress the core material; a plurality of cartridge cases; gun powder; one or more reloading dies; bullet jackets; a scale; a priming tool; a powder measure; a bullet puller; a case trimmer; primer pocket tools; a press; cartridge cases; a sharp edge shaving tool for shaping the bullet core material prior to shaping or after; boxer primers; a shellholder; and smokeless powder and combinations thereof, wherein the kit is made available to a consumer for purchase as a unit.

In one embodiment, there is provided a method of making a kit for rifle and pistol ammunition reloaders for creating their own bullets including a packaged bullet core material suitable for commercial sale to reloaders and suitable for forming into bullets and configuring into a cartridge using standard reloading equipment and processes comprising the steps of:

(a) forming a particulate metal mixture comprising, a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof, and (b) preparing a slurry comprising, (i) said homogenous particulate metal mixture, (ii) water, (iii) a binder selected from the group consisting of thermoplastics and/or thermosetting polymers, polyurethane, polyolefin, polyester, polyvinyl alcohol, poly (C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations thereof, wherein said slurry contains, said first metal in an amount of from 50 to 99.5 percent by weight, based on the total weight of said slurry;

(c) passing said slurry through a spray drier, thereby forming a bullet core material, wherein said bullet core material substantially comprises, said first metal in an amount of from 50 percent by weight to 99.5 percent by weight, based on the total weight of said material, and said material is substantially free flowing;

(d) packaging the bullet core material in a form and method suitable for commercial sale to reloaders and suitable for forming into bullets and configuring into a cartridge using standard reloading equipment and processes; and (e) packaging the packaged bullet core material with reloading equipment chosen from the group consisting of: a pressurizer configured to compress the core material; a bullet jacket swaging device; metallic jackets; a heatable pressurizer configured to compress the core material; a plurality of cartridge cases; gun powder; one or more reloading dies; bullet jackets; a scale; a priming tool; a powder measure; a bullet puller; a case trimmer; primer pocket tools; a press; cartridge cases; a sharp edge shaving tool for shaping the bullet core material prior to shaping or after; boxer primers; a shellholder; and smokeless powder and combinations thereof, wherein the kit is made available to a consumer for purchase as a unit.

In one embodiment, the reloading equipment comprises: 1) a mold; 2) bullet core material; 3) a pressurizer configured to compress the core material; 4) a bullet jacket swaging device having a cavity geometry; and 5) metallic jackets, wherein the kit is made available to a consumer for purchase as a unit. The kit can further comprise an instruction guide, wherein the instruction guide includes instructions comprising the steps of:

a) providing the bullet core material from the kit;

b) cutting the composition to desired length or size;

c) placing the cut piece of composition material in a metal jacket;

d) compressing the jacket with the composition therein to form a bullet core using the pressurizer until a desired consistency of density is achieved;

e) removing leftover core material;

f) pressing the jacket with the core in the swaging device to conform the jacket and core to the cavity geometry to create a jacketed bullet; and g) removing the jacketed bullet.

In some embodiments, the instruction guide further comprises the step of: loading the jacketed bullet using standard reloading equipment and processes. In some embodiments, the amount of a metallic-polymer composition is in aliquots in an approximate size need for one bullet.

In one embodiment, the reloading equipment comprises: 1) a heatable mold; 2) bullet core material; and 3) a heatable pressurizer configured to compress the core material, wherein the kit is made available to a consumer for purchase as a unit. In still further embodiments, the kit further comprises an instruction guide, wherein the instruction guide includes instructions comprising the steps of a) providing the bullet core material from the kit;

b) dumping the bullet core material into a hopper;

c) heating the hopper and mixing the bullet core material sufficiently to mix and melt the bullet core material to a homogenous state, wherein the material exhibits flow qualities;

d) if the fluid characteristics of the resulting bullet core material are adequate for injecting, injecting the material by means of a forced mechanism into the heatable mold cavity, or if the viscosity of the resulting bullet core material is sufficiently low, pouring the bullet core material into a cavity of the heatable mold; and e) closing and heating the heatable mold until the bullet core material is of a desired hardness, forming a bullet.

In further embodiments, the reloading equipment comprises: 1) a plurality of cartridge cases; 2) packaged bullet core material; and 3) gun powder, wherein the kit is made available to a consumer for purchase as a unit. In further embodiments, the core material comprises a packaged amount of a metallic-polymer composition suitable for forming into bullets and configuring into a cartridge using standard reloading equipment and processes. In further embodiments, the reloading equipment further comprises a plurality of boxer primers and an instruction guide, wherein the instruction guide includes instructions comprising the steps of:

a) providing the bullet core material composition from an acquired kit or acquired separately;

b) making a jacketed bullet or a jacketless bullet using the bullet core material using reloading equipment and processes;

c) inserting the desired amount of gun powder into the cartridge case;

d) fitting a boxer primer into the rear end of the cartridge case; and e) fitting the prepared jacketed or jacketless bullet into the open end of the cartridge case and securing.

The above summary of the various embodiments is not intended to describe each illustrated aspect or every implementation. Rather, the embodiments are chosen and described so that others skilled in the art can appreciate and understand principles and practices. The figures in the detailed description that follow more particularly exemplify these embodiments.

Still other objects and advantages of the disclosure and methods of construction of the same will become readily apparent to those skilled in the art from the following detailed description, wherein only the preferred embodiments are shown and described. As will be realized, other and different embodiments and methods of construction are enabled by the disclosure, and its several details are capable of modification in various obvious respects. Accordingly, the drawing and description are to be regarded as illustrative in nature, and not as restrictive.

BRIEF DESCRIPTION OF THE DRAWINGS

The disclosure can be completely understood in consideration of the following detailed description of various embodiments in connection with the accompanying drawings, in which.

Figure 1:
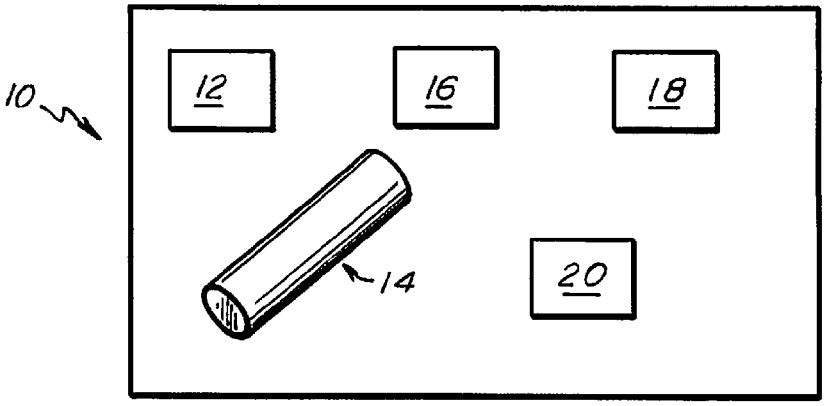
FIG. 1 shows a schematic representation of a bullet swaging kit in an embodiment of the disclosure.

While the embodiments disclosed herein are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure as defined by the appended claims.

DETAILED DESCRIPTION OF THE DRAWINGS

Described in detail herein are specific embodiments of the disclosure. This description is an exemplification of the principles of the disclosure and is not intended to limit the scope of the disclosure to the particular embodiments illustrated.

For the purposes of this disclosure, like reference numerals in the figures shall refer to like features unless otherwise indicated.

Description of the Bullet Material Composition

In one embodiment, the bullet material comprises a moldable composition for producing lead-free bullets for rifle and pistol shooting applications. The moldable composition comprises a high-density, metal-filled, polymer material which is free of lead or other toxic materials. The composition includes moldable and flowing qualities such that consumers can "inject" it into a bullet shape mold to form lead-free bullets. In another embodiment, the composition material is formulated such that it may be shaped and made into a cylindrical-shaped bullet core by a private reloader who may than swage commercially available copper jackets around cylindrical-shaped core of the composition material to make a jacketed bullet.

In some embodiments, the bullet material composition comprises a polymer carrier/binder material and non-lead particles mixed and dispersed therein. The concentration of non-lead particles may be varied as a percentage of the composition material based on desired bullet density and weight. Choice of polymer may also be varied for desired physical characteristics.

In one embodiment, the non-lead particles included in the bullet material composition comprises metals and alloys conventionally used in bullet jacket formation, such as copper and copper alloys, in amounts sufficient enough to produce a desirable density for shooting applications without a jacket.

In one embodiment, the bullet material composition may be produced in the form of an extruded round cross-section (rope-like) material spooled for distribution. It may have a putty-like flexible consistency, pliable, and easily cut to desired length.

In another embodiment, the bullet material composition may be processed into powder form, which may be packaged and in use heat formed within a heating mold.

In another embodiment, the bullet material composition may be processed into pellet form for easy metering and distribution. The bullet composition material can be utilized alone or in combination with other suitable components.

The bullet composition material is formulated and prepared so that it can be packaged and subsequently molded or formed into a bullet for use in existing private reloading equipment and processes for standard firearms. The bullet composition material may also be cut, sized or weighted in aliquots specifically for certain types of bullets before the material is packaged. The bullet composition may be in the form of a tube, a brick, measured aliquots, or a rope-like spool prior to packaging and packaged in such a form.

In one embodiment, the composition material is formulated such that it may be packaged and sold on-line or in store location. Whereupon the sale to an end consumer, the consumer may take receipt of the packaged material and use it for home reloading purposes. The composition material is formulated such that it retains its moldable and injectable qualities.

In some embodiments, the bullet composition material is formulated to form material suitable for commercial sale to reloaders and suitable for forming into bullets and configuring into a cartridge using standard reloading equipment and processes. In various embodiments, a method of making the bullet composition material comprises the steps of:

(a) forming a particulate metal mixture comprising non-lead metal particles, and (b) preparing a slurry comprising, (i) said homogenous particulate metal mixture, (ii) water, (iii) a polymer carrier/binder, wherein said slurry contains the non-lead metal particles in an amount of from 50 to 99.5 percent by weight, based on the total weight of said slurry;

(c) passing said slurry through a spray drier, thereby forming a bullet core material, wherein said bullet core material substantially comprises, metal particulars in an amount of from 50 percent by weight to 99.5 percent by weight, based on the total weight of said material, and said material is substantially free flowing; and (d) packaging the bullet core material in a form and method suitable for commercial sale to reloaders and suitable for forming into bullets and configuring into a cartridge using standard reloading equipment and processes. In one embodiment, the resulting material is then formed into a tube, a brick, measured aliquots or a rope-like spool, prior to packaging and packaged in such a form.

Suitable materials for the non-lead particles include: copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum other high density metals and non-lead alloys and combinations thereof).

Suitable materials for the polymer carrier/binder material include thermoplastics and/or thermosetting polymers, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, phenol formaldehyde or polymethylmethacrylate polymers, suitable amorphous or has a low crystallinity polymers, polycarbonate, TPE, phenolics, epoxies, dialylphthalates, acrylics, polystyrenes, polyethylene, and combinations and resins thereof.

In some embodiments, the composition substantially comprises, said first metal in an amount of from 10 percent by weight to 99.5 percent by weight, based on the total weight of said composition.

In some embodiments, the composition substantially comprises, said first metal in an amount of from 30 percent by weight to 99.5 percent by weight, based on the total weight of said composition.

In some embodiments, the composition substantially comprises, said first metal in an amount of from 30 percent by weight to 90 percent by weight, based on the total weight of said composition.

In some embodiments, the composition substantially comprises, said first metal in an amount of from 30 percent by weight to 80 percent by weight, based on the total weight of said composition.

In some embodiments, the non-lead particles are chosen from the group consisting of tungsten, tungsten alloy, iron, and copper.

Description of the Bullet Making Kits and Methods of Use

In further embodiments, there is provided a bullet making kit for a private reloader which may be package for sale. In one embodiment, the bullet making kit comprises tools for making bullets and the bullet material composition. The tools of the kit may be used with the bullet material composition for forming and making the bullets. One embodiment includes a swaging kit, a mold kit, a general kit and a bullet reloading kit providing for various methods of making. Kits may include all of the items in on package or may refer to items sold together as one unit.

Bullet Swaging Kit

Figure 8:
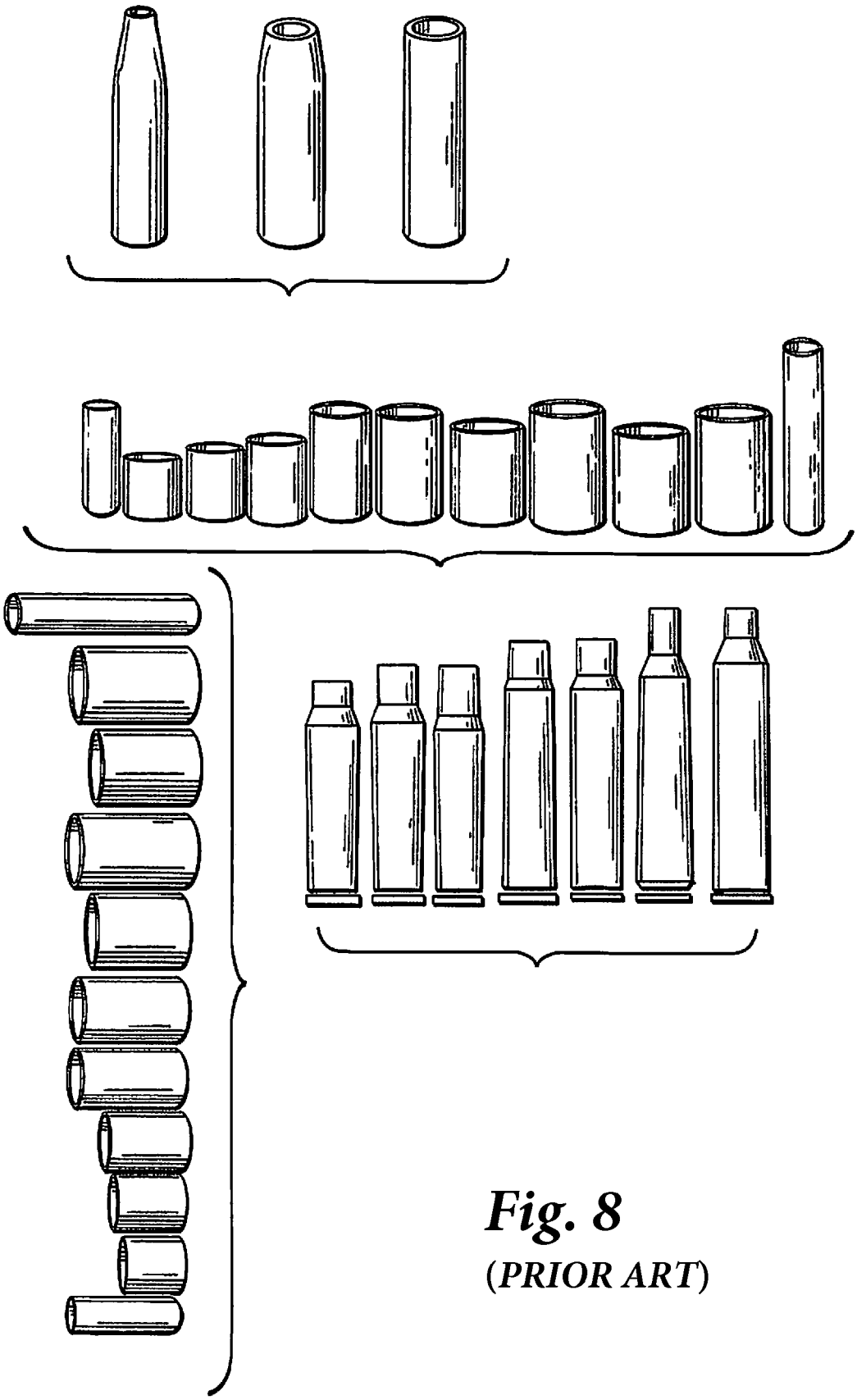
Fig. 8 ( PRIOR ART )
FIG. 8 shows examples of bullet jackets similar to those used in the present disclosure.

In one embodiment, there is disclosed herein a bullet swaging kit 10, as shown in schematic FIG. 1. This kit provides the consumer hobbyist shooter the ability to produce lead-free bullets at home for use in standard rifle and pistol calibers. The bullet swaging kit 10 comprises: mold cavities 12, which may heated mold cavities or cold mold cavities); core material 14, wherein the core material comprises the packaged metallic-polymer composition bullet material; a pressurization system/pressurizer 16 to compress the core material; bullet jacket swaging equipment (swaging die) 18, which may include a press with an ogive shaped die and a punch; and metallic jackets 20 (any commercially available jacket, including copper or similar malleable metal jackets. Examples may be seen in FIG. 8).

In one embodiment, the bullet material composition is in the form of an extruded round cross-section (rope-like) material, optionally spooled in its packaged state. It may have a putty-like flexible consistency, pliable, and easily cut to desired length.

Figure 2:
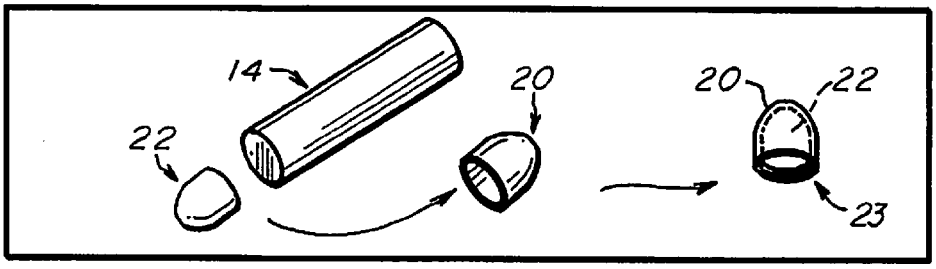
FIG. 2 shows a schematic representation of a method used with a bullet swaging kit in an embodiment of the disclosure.

In the method of using the kit, as shown in FIG. 2, a length of material 22 is cut and placed in a metal jacket 20. The jacket with the contained bullet material composition is compressed to a certain pressure using the reloading press 16. This pressure is applied until a desired consistency of density is achieved. Any leftover extra core material would then be wiped off and collected for future use. The jacket with core material 23 is then placed into the swaging die 18, which contains an ogive-shaped cavity, and pressed in with sufficient force to conform the jacketed core bullet material to the cavity's geometry.

Upon removal from the die, the bullet core material would be ready to load and shoot using standard reloading equipment and processes.

In one embodiment, a powder form of the bullet composition of said material is used instead of the putty form. With the powder form, the mold may be heated to more effectively pack and harden the core material.

In one embodiment, the kit may further comprise an instruction guide. The instruction guide can include instructions comprising the steps of:

1) providing the bullet material composition from an acquired kit or acquired separately;
2) if the bullet material composition is in extruded form, cutting the composition to desired length or size;
3) placing the cut piece of bullet material composition material in a metal jacket;
4) compressing the jacket with the contained bullet material composition to form the bullet core using the reloading press, either from the acquired kit or acquire separately, until a desired consistency of density is achieved;
5) removing any leftover extra core material and optionally collect for future use;
6) pressing the jacket with the core in the swaging die, which contains an ogive-shaped cavity, to conform the jacketed core bullet material to the cavity's geometry;
7) removing the now jacketed bullet; and
8) loading the bullet using standard reloading equipment and processes.

In the above instruction, if the bullet material composition is in a powder, the desired amount of powder material may be placed directly into a heatable mold/reloading press and the mold may be heated to pack and harden the core material in the desired bullet shape while conducting the press step.

Bullet Mold Kit

Figure 3:
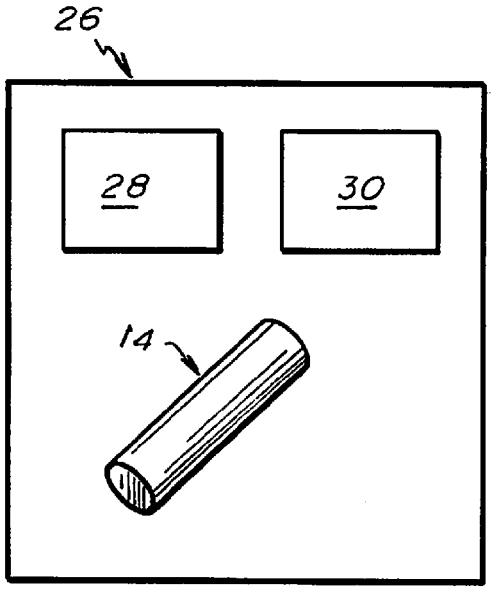
FIG. 3 shows a schematic representation of a bullet mold kit in an embodiment of the disclosure.

In one embodiment, there is disclosed herein a bullet mold kit 26, as shown in FIG. 3. This kit provides the consumer hobbyist shooter the ability to produce lead-free bullets at home for use in standard rifle and pistol calibers. The bullet mold kit 26 comprises: heated mold cavity 28; core material 14, wherein the core material comprises the packaged metallic-polymer composition bullet material; and a heated pressurization system 30 to compress/inject the core material.

In another embodiment, this bullet composition material include sufficient copper or copper alloy particles, or other suitable bullet jacket metallic alloys, so as to eliminate the need for an external jacket. Such composition may include other types of metallic particles in the metallic-polymer composition, formulated in quantities to produce a desirable density for shooting applications. In another embodiment, the material may be produced in a pellet form, or similar, for easy metering and distribution.

Figure 4:
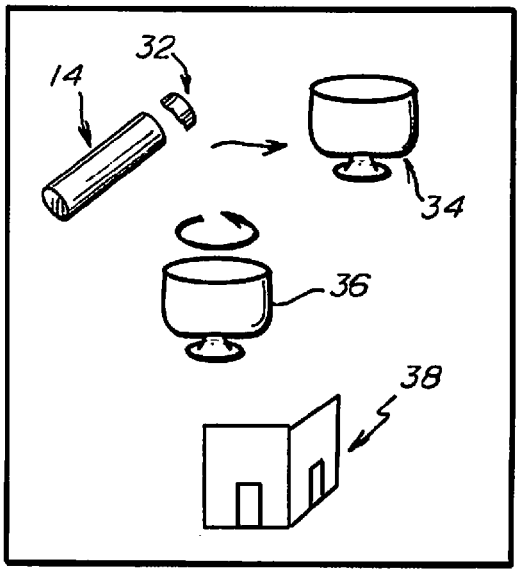
FIG. 4 shows a schematic representation of a method used with a bullet mold kit in an embodiment of the disclosure.
Figure 7:
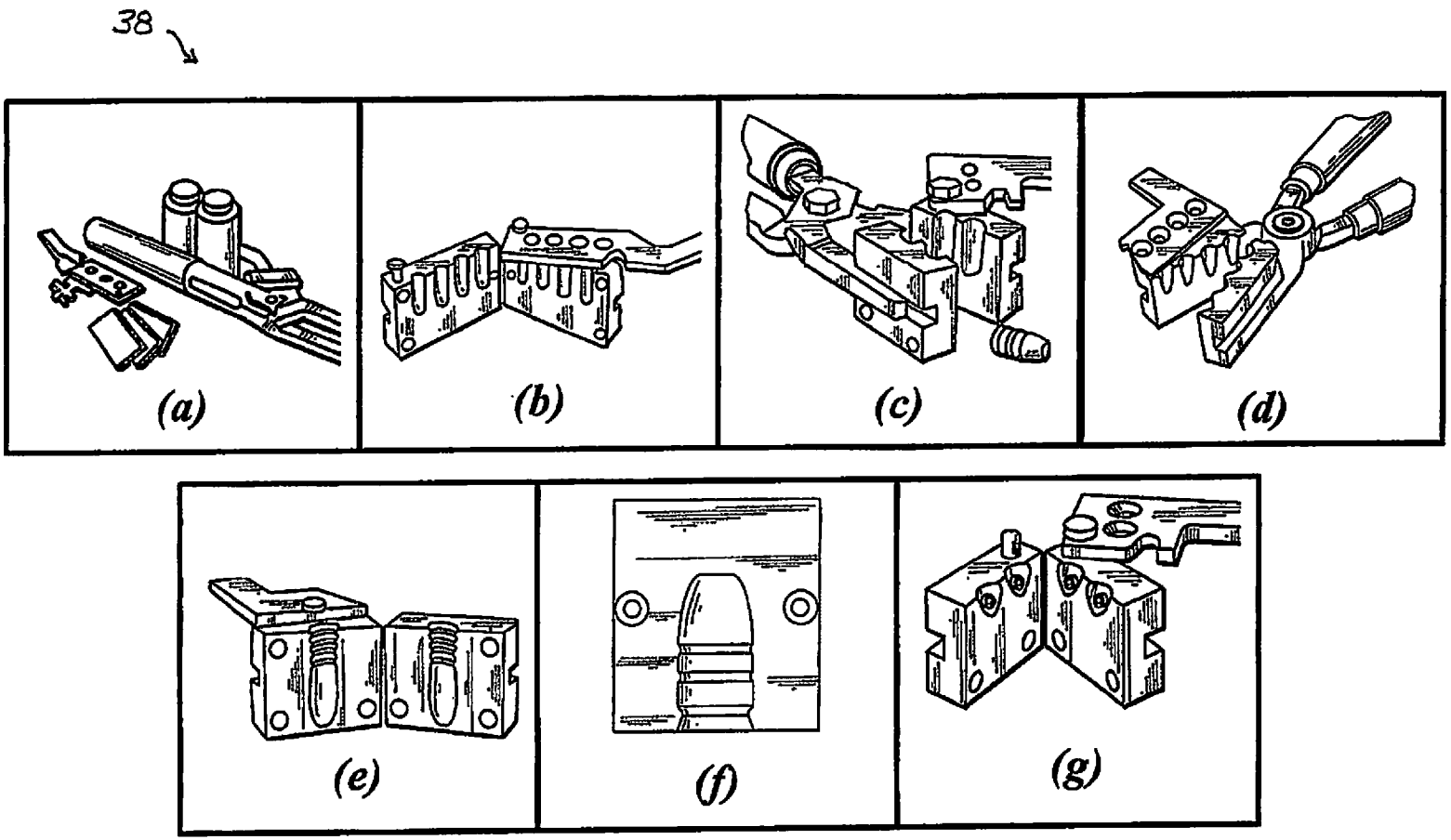
Fig. 7 (PRIOR ART)
FIG. 7 shows examples of conventional mold cavities similar to those used in the present disclosure: (a) bullet mould accessories; (b) LYMAN bullet moulds; (c) RCBS bullet moulds; (d) SAECO bullet moulds; (e) BUFFALO ARMS moulds; (f) PEDERSOLI bullet moulds; (g) round ball moulds.
Figure 15:
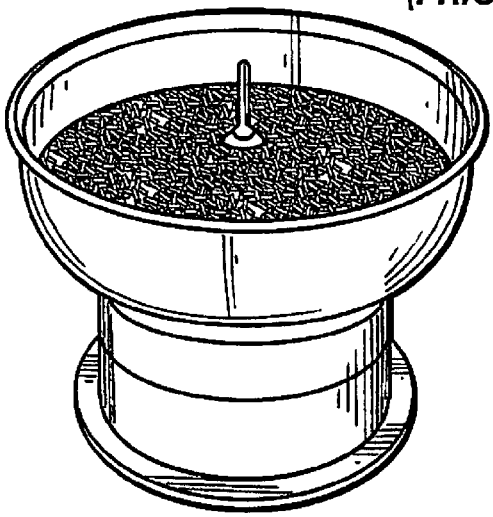
Fig. 15 (PRIOR ART)
FIG. 15 shows an example of a conventional tumbler similar to those used in the present disclosure.

In one embodiment, in use of the kit 26, as shown in FIG. 4, the end user of the kit takes an amount 32 of the bullet composition material 14 is dumped into a hopper 34 (an example of which is shown in FIG. 15), feeding a heated containment. The material is sufficiently mixed and melted 36 to a homogenous state, wherein the material exhibits flow qualities. Depending on resulting fluid characteristics of the resulting material, it may either be injected by means of a forced mechanism (actuator, lead screw, or other means) into a mold cavity 38, examples of which are shown in FIG. 7, or, if the resulting viscosity sufficiently low, simply poured (gravity fed) into a mold cavity 38. The mold 38 may be a heated mold or a cold mold. Upon solidification of the bullet material and removal from the mold, the bullet is ready to loaded and shot using standard reloading equipment and processes.

In one embodiment, the kit further may comprise an instruction guide. In one embodiment, the instruction guide includes instructions comprising the steps of:

1) providing the bullet material composition from an acquired kit or acquired separately, wherein the bullet material composition includes sufficient copper or copper alloy particles, or other suitable bullet jacket metallic alloys, so as to eliminate the need for an external jacket. Such composition may include other types of metallic particles in the metallic-polymer composition, formulated in quantities to produce a desirable density for shooting applications;
2) dumping the bullet material composition into a hopper;
3) heating the hopper and mixing the material sufficiently to mix and melt the composition to a homogenous state, wherein the material exhibits flow qualities;
4) if the fluid characteristics of the resulting material are adequate for injecting, injecting the material by means of a forced mechanism (actuator, lead screw, or other means) into a mold cavity; or
5) if the resulting viscosity is sufficiently low, pouring (gravity fed) the material into a mold cavity;
6) closing and heating the mold (cold mold may be used);
7) upon solidification of the bullet material, removing the formed bullet from the mold; and
8) loading the bullet using standard reloading equipment and processes.

General Bullet Making Kit

Figure 5:
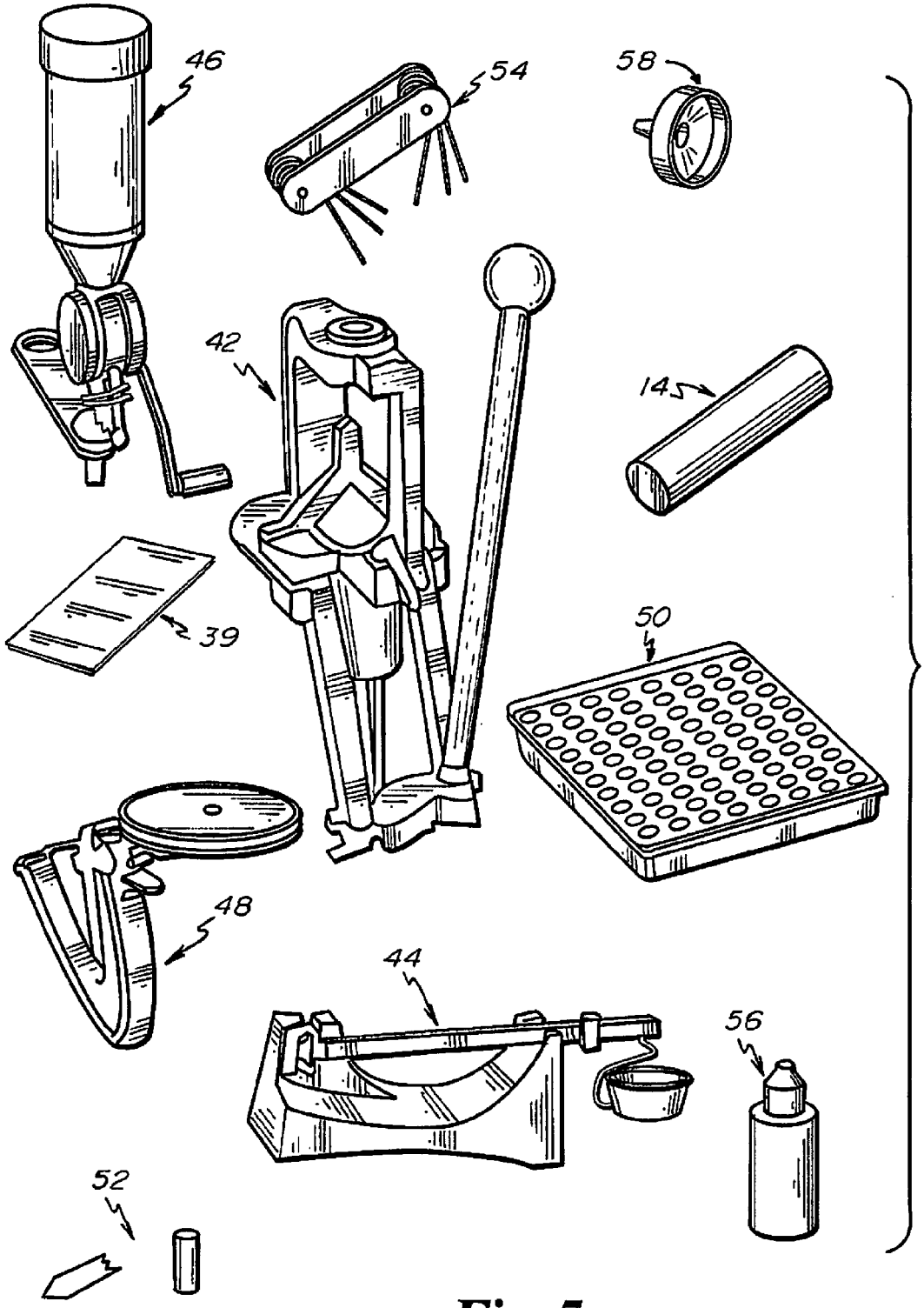
FIG. 5 shows a schematic representation of a general bullet making kit in an embodiment of the disclosure.

In a further embodiment, there is disclosed herein a general bullet making kit, as shown in FIG. 5. This kit provides the consumer hobbyist shooter the ability to produce lead-free bullets at home for use in standard rifle and pistol calibers. The general bullet making kit comprises: core material 14, wherein the core material comprises the packaged metallic-polymer composition bullet material; a press 42; a reloading scale 44; a uniflow powder measure 46; a hand priming tool 48; a case loading block 50; a debur tool 52; a hex key set 54; a case lube kit 56; an instruction guide 39, which may be included in all kits, and a powder funnel 58.

Bullet Reloading Kit

Figure 6:
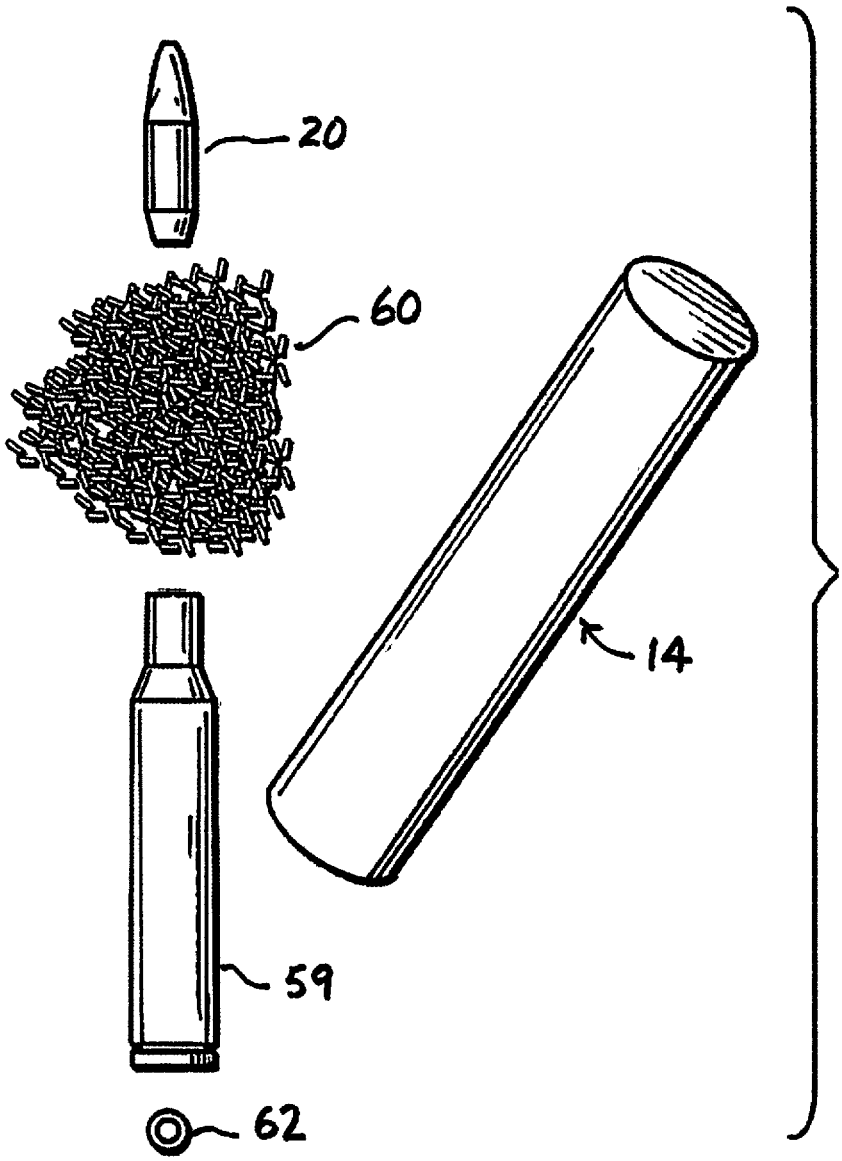
FIG. 6 shows a schematic representation of a bullet reloading kit in an embodiment of the disclosure.

In a further embodiment, there is disclosed herein a bullet reloading kit, as shown in FIG. 6. This kit provides the consumer hobbyist shooter the ability to produce lead-free bullets and reload a modern rifle cartridge at home for use in standard rifle calibers. The bullet reloading kit comprises: core material 14, wherein the core material comprises the packaged metallic-polymer composition bullet material; a plurality of cartridge cases 59; gun powder 60, preferably smokeless powder granules; a plurality of bullet jackets 20; and a plurality of boxer primers 62, wherein the kit is made available to a consumer for purchase as a unit.

In one embodiment, the kit further may comprise an instruction guide. In one embodiment, the instruction guide includes instructions comprising the steps of 1) providing the bullet core material composition from an acquired kit or acquired separately;
2) making a jacketed bullet or a jacketless bullet using the bullet core material using standard reloading equipment and processes and/or the methods described herein;

3) inserting the desired amount of gun powder into the cartridge case;
4) fitting a boxer primer into the rear end of the cartridge case; and
5) fitting the prepared jacketed or jacketless bullet into the open end of the cartridge case and securing.

Figure 9:
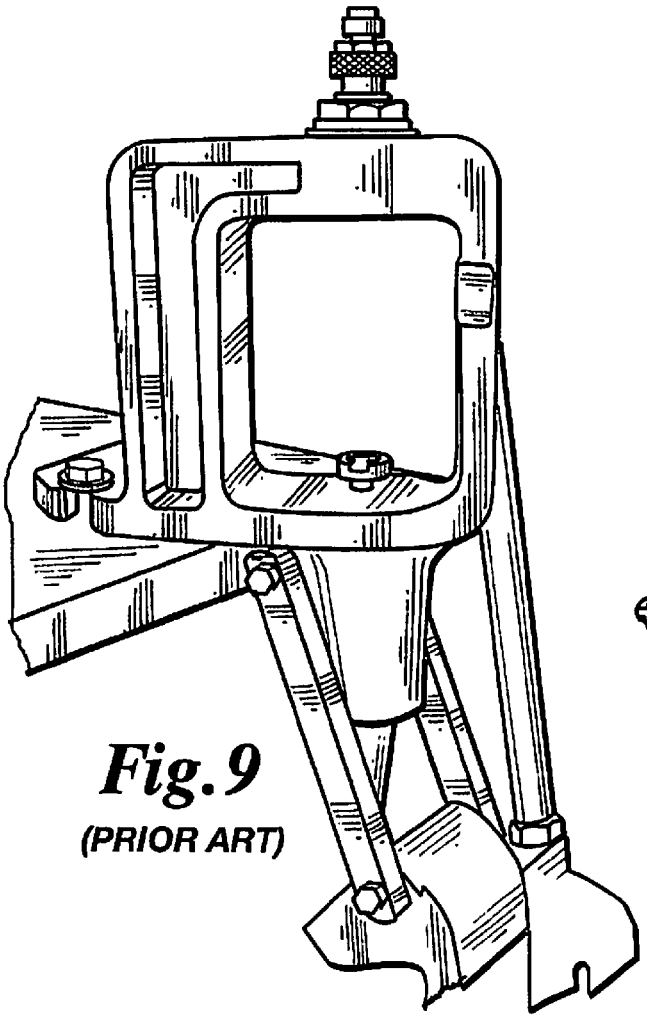
Fig. 9 (PRIOR ART)
FIG. 9 shows an example of a conventional press similar to those used in the present disclosure.
Figure 11:
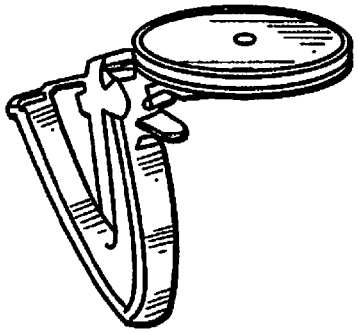
Fig. 11 (PRIOR ART)
FIG. 11 shows example of a conventional priming tool similar to those used in the present disclosure.
Figure 10:
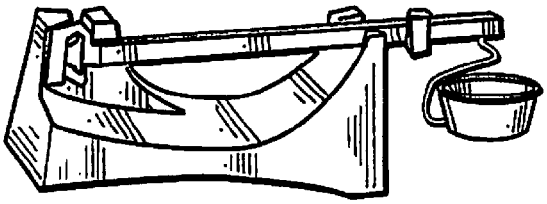
Fig. 10 (PRIOR ART)
FIG. 10 shows an example of a conventional scale similar to those used in the present disclosure.
Figure 12:
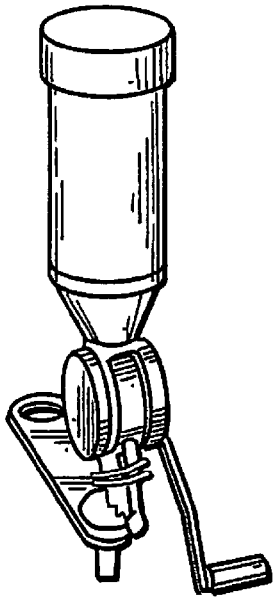
Fig. 12 (PRIOR ART)
FIG. 12 shows an example of a conventional powder measure similar to those used in the present disclosure.
Figure 13:
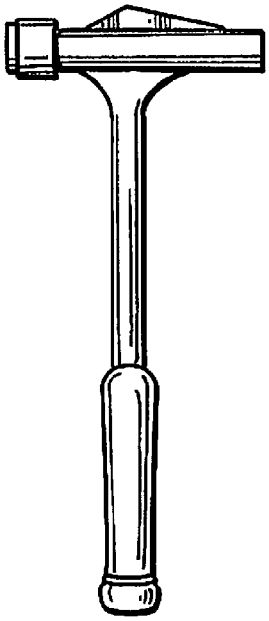
Fig. 13 (PRIOR ART)
FIG. 13 shows an example of a conventional bullet puller similar to those used in the present disclosure.
Figure 14:
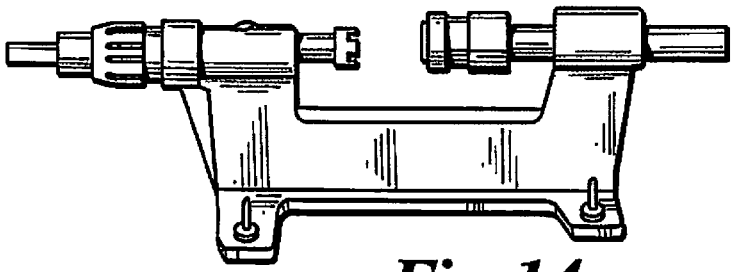
Fig. 14 (PRIOR ART)
FIG. 14 shows an example of a conventional case trimmer similar to those used in the present disclosure.
Figure 16:
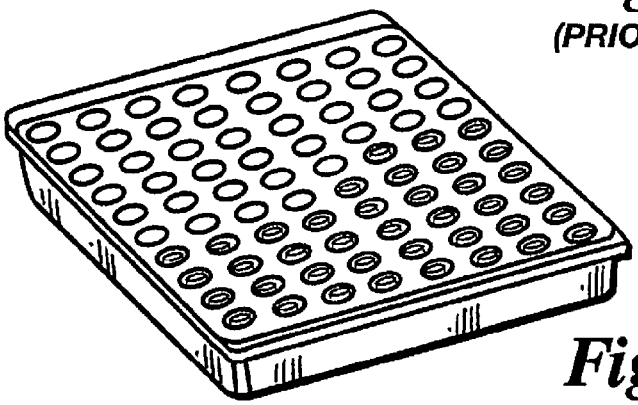
Fig. 16 (PRIOR ART)
FIG. 16 shows an example of conventional primers similar to those used in the present disclosure.
Figure 17:
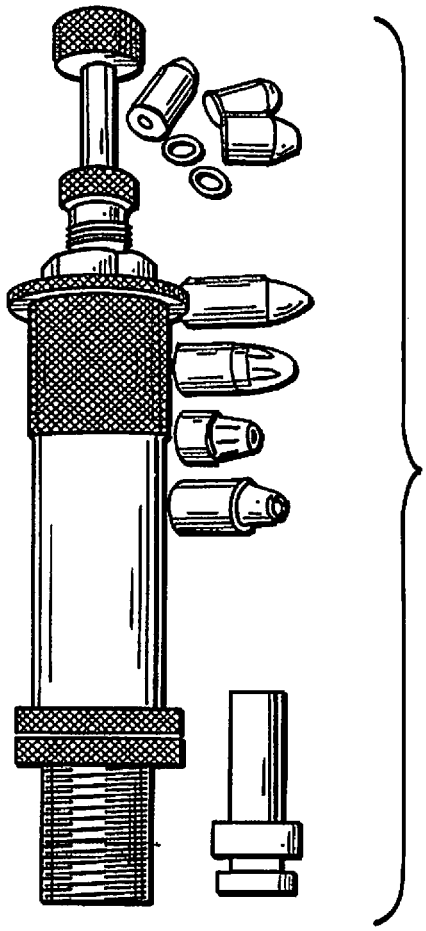
Fig.17 (PRIOR ART)
FIG. 17 shows an example of a conventional swage, in a swage kit, similar to those used in the present disclosure.
Figure 18:
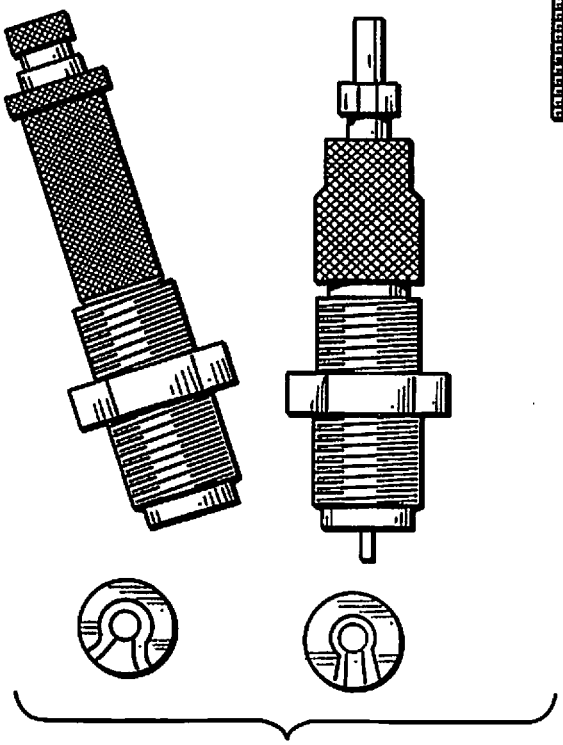
Fig.18 (PRIOR ART)
FIG. 18 shows examples of conventional reloading dies and shell holders similar to those used in the present disclosure.

For any of the kits herein, the kit may further comprises any of the following: one or more reloading dies or a reloading press with die (example shown in FIG. 9); bullet jackets 20; a scale (example shown in FIG. 10); a priming tool (example shown in FIG. 11); a powder measure (example shown in FIG. 12); a bullet puller (example shown in FIG. 13); a case trimmer (example shown in FIG. 14); primer pocket tools; a press (example shown in FIG. 9); cartridge cases (example shown in FIG. 8); boxer primers (62 in FIG. 6 and FIG. 16); smokeless powder (60 in FIG. 6), a swage (example of a swage in a swage kit shown in FIG. 17) and reloading dies and shell holders (example shown in FIG. 18).

For any of the kits herein, the kit may further comprises a drilling tool or an awl tool to insert a indention or hole at the meplat of the prepared bullet for converting said bullet into a hollow point type bullet. The methods of the present disclosure may further include the step of inserting a indention or drilling a hole at the meplat of the prepared bullet for converting said bullet into a hollow point type bullet.

Various embodiments further provide for combinations of the kit items described above and other convention tools and materials used in reloading. Various embodiments further provide for kits comprises the bullet composition material in different packaged forms, including pliable extruded form, powder form and/or pellet form. Kits may also contain combinations of the forms and/o combinations of bullet composition materials having different formulations, densities and weights. The kits may have any suitable or desired combination.

For any of the methods of making a bullet disclosed herein, a sharp edge shaving tool may be used to shape the bullet core material prior to shaping the bullet in the mold or afterward to remove stray portions or to truncate the end.

While the disclosure describes and discloses certain embodiments and procedures, it is not intended to limit the invention to those specific embodiments. Rather it is intended to cover all such alternative embodiments and modifications as fall within the spirit and scope of the disclosure.

Those skilled in the art will appreciate that changes and modifications can be made to the composition and kits and the methods of use disclosed herein without departing from the spirit and scope of the present disclosure as set forth as defined by the claims below.

References US Pub 2006/0283314, US Pub 2006/0027129, U.S. Pat. No. 5,399,187, U.S. Pat. No. 5,665,808, U.S. Pat. No. 7,503,260, and U.S. Pat. No. 6,048,379, as well as references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. The above described embodiments are merely descriptive of its principles and are not to be considered limiting. Further modifications of the embodiments herein disclosed will occur to those skilled in the respective arts and all such modifications are deemed to be within the scope of the disclosure.

What is claimed is:

1. A method of supplying bullets for hand loaded ammunition, comprising:

providing a kit for use by an individual reloader, said kit including a bullet core material comprising a polymer material and an instruction guide that includes instructions, the instructions comprising:

selecting a quantity of said bullet core material;

heating and melting said quantity of said bullet core material until said bullet core material exhibits flow qualities and to a homogenous state; and manually disposing said quantity of said bullet core material into one of a bullet jacket and a mold, the manually disposing including injecting the bullet core material, wherein the heating and the manual disposing is performed with a heatable pressurizer.

2. The method of claim 1, the bullet core material being in an extruded form, wherein said extruded form of said bullet core material is selected from the group consisting of a tube, a rope-like spool, and a round cross-section.

3. The method of claim 2, wherein the step in said instructions of selecting a quantity of said bullet core material includes measuring a length of said extruded form.

4. The method of claim 1, wherein said kit includes a plurality of bullet jackets.

5. The method of claim 1, wherein said kit is made available for purchase as a unit by a hobbyist reloader, and bullets made therefrom are for personal use of the hobbyist reloader.

6. The method of claim 1, wherein said bullet core material comprises:

a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; and a binder selected from the group consisting of a thermoplastic, a thermosetting polymer, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, a phenol formaldehyde polymer, a polymethylmethacrylate polymer, an amorphous polymer, a low crystallinity polymers, polycarbonate, a thermoplastic elastomer, phenolics, epoxies, dialylphthalates, acrylics, polystyrenes, polyethylene, and combinations thereof.

7. The method of claim 1, the bullet core material being in an extruded form, wherein the step in said instructions of selecting a quantity of said bullet core material includes cutting a length of said extruded form of the bullet core material.

8. The method of claim 1, wherein the step of heating is performed before the step of disposing.

9. The method of claim 1, wherein said kit includes said heatable pressurizer.

10. The method of claim 1, wherein the step in said instructions of manually disposing said bullet core material includes pouring said bullet core material.

11. The method of claim 1, wherein:

said kit includes a plurality of bullet jackets; and the step in said instructions of manually disposing said bullet core material instructs to manually dispose said bullet core material in one of said plurality of bullet jackets.

12. A method of supplying bullets for hand loaded ammunition, comprising:

providing a kit for use by an individual reloader, said kit including a bullet core material comprising a polymer material and an instruction guide that includes instructions, the instructions comprising:

selecting a quantity of said bullet core material;

heating said quantity of said bullet core material until said bullet core material exhibits flow qualities; and manually disposing said quantity of said bullet core material into one of a bullet jacket and a mold, the manually disposing including injecting the bullet core material, wherein the heating and the manual disposing is performed with a heatable pressurizer, the bullet core material comprising:

a first metal selected from the group consisting of copper, tungsten, zirconium, steel, titanium, hafnium, niobium, tantalum, iron, tin, aluminum, zinc, tungsten carbide, ferro-tungsten, bismuth, stainless steel, carballoy, tantalum, molybdenum, combinations thereof, and alloys thereof; and a binder selected from the group consisting of a thermoplastic, a thermosetting polymer, polyurethane, polyolefin, polyester, polyvinyl alcohol, poly(C2-C5-alkylene glycol), hydroxyalkylcellulose, polyacrylate, polymethacrylate, ethylene/methacrylic acid copolymer ionomer, polyetherester elastomer, polydicyclopentadiene, polydimethylsiloxane, polyamide, polycarbonite, a phenol formaldehyde polymer, a polymethylmethacrylate polymer, an amorphous polymer, a low crystallinity polymers, polycarbonate, a thermoplastic elastomer, phenolics, epoxies, dialylphthalates, acrylics, polystyrenes, polyethylene, and combinations thereof, wherein said first metal of said bullet core material comprises an amount of from 50 percent by weight to 99.5 percent by weight, based on the total weight of said composition.

13. A method of supplying bullets for hand loaded ammunition, comprising:

providing a kit for use by an individual reloader, said kit including a bullet core material comprising a polymer material, wherein said bullet core material is substantially free flowing, and an instruction guide that includes instructions, the instructions comprising:

selecting a quantity of said bullet core material;

heating said quantity of said bullet core material until said bullet core material exhibits flow qualities; and manually disposing said quantity of said bullet core material into one of a bullet jacket and a mold, the manually disposing including injecting the bullet core material, wherein the heating and the manual disposing is performed with a heatable pressurizer.

14. A method of supplying bullets for hand loaded ammunition, comprising:

providing a kit for use by an individual reloader, said kit including a bullet core material comprising a polymer material and an instruction guide that includes instructions, the instructions comprising:

selecting a quantity of said bullet core material;

heating said quantity of said bullet core material until said bullet core material exhibits flow qualities;

manually disposing said quantity of said bullet core material into one of a bullet jacket and a mold, the manually disposing including injecting the bullet core material; and manually compressing said bullet core material within said bullet jacket wherein the heating and the manual disposing is performed with a heatable pressurizer.

15. A method of supplying bullets for hand loaded ammunition, comprising:

providing a bullet core material comprising a polymer material;

selecting a quantity of said bullet core material;

heating and melting said quantity of said bullet core material until said bullet core material exhibits flow qualities and to a homogenous state; and manually disposing said quantity of said bullet core material into one of a bullet jacket and a mold, the manually disposing including injecting the bullet core material, wherein the heating and the manual disposing is performed with a heatable pressurizer.

* * * * *